US006595529B2

(12) United States Patent
Erdman

(10) Patent No.: US 6,595,529 B2
(45) Date of Patent: Jul. 22, 2003

(54) MULTI-HINGED SKATE AND METHODS FOR CONSTRUCTION OF THE SAME

(76) Inventor: Arthur G. Erdman, 1957 - 3rd St. SW., New Brighton, MN (US) 55112

( * ) Notice: Subject to any disclaimer, the term of this patent is extended or adjusted under 35 U.S.C. 154(b) by 0 days.

(21) Appl. No.: 10/151,976

(22) Filed: May 20, 2002

(65) Prior Publication Data

US 2002/0163145 A1 Nov. 7, 2002

Related U.S. Application Data

(63) Continuation of application No. 09/435,972, filed on Nov. 8, 1999, now Pat. No. 6,431,558, which is a continuation of application No. 08/820,588, filed on Mar. 19, 1997, now abandoned.

(60) Provisional application No. 60/013,681, filed on Mar. 19, 1996.

(51) Int. Cl.[7] ..... A63C 17/20

(52) U.S. Cl. ..... 280/11.216; 280/11.36; 280/11.221; 280/11.224; 36/115

(58) Field of Search ..... 36/115, 118.2, 36/114; 280/11.36, 11.211, 11.214, 11.215, 11.216, 11.224, 11.26

(56) References Cited

U.S. PATENT DOCUMENTS

| | | | | | |
|---|---|---|---|---|---|
| 472,711 | A | | 4/1892 | Miles | |
| 920,848 | A | * | 5/1909 | Eubank, Jr. | 280/11.214 |
| 926,646 | A | * | 6/1909 | Eubank, Jr. | 280/11.214 |
| 975,820 | A | | 11/1910 | Azzara | |
| 979,169 | A | * | 12/1910 | Kennedy | 280/11.214 |
| 1,418,188 | A | | 5/1922 | Jacobs | |
| 1,497,224 | A | * | 9/1924 | Ormiston | 280/11.214 |
| 1,687,739 | A | * | 10/1928 | Slusher | 280/11.214 |
| 2,209,116 | A | | 7/1940 | Friedman | |
| D203,805 | S | | 2/1966 | Werner | |
| 3,235,978 | A | | 2/1966 | Hyde | |
| 3,239,952 | A | | 3/1966 | Lange | |
| 3,303,584 | A | | 2/1967 | Werner | |
| 3,597,862 | A | | 8/1971 | Vogel | |
| 3,686,778 | A | | 8/1972 | Hornung | |
| 4,072,317 | A | * | 2/1978 | Pommerening | 280/11.36 |
| 4,107,856 | A | | 8/1978 | Bourque | |
| 4,351,537 | A | | 9/1982 | Seidel | |
| 4,365,462 | A | | 12/1982 | Werner et al. | |
| 4,384,413 | A | | 5/1983 | Bourque | |
| 4,385,456 | A | | 5/1983 | Livernois et al. | |

(List continued on next page.)

FOREIGN PATENT DOCUMENTS

| | | |
|---|---|---|
| CA | 1066500 | 11/1979 |
| CA | 1066501 | 11/1979 |
| CH | 377225 | 4/1964 |
| DE | 2856893 | 1/1980 |
| EP | 0030225 | 11/1980 |
| FR | 7635991 | 11/1976 |

*Primary Examiner*—Brian L. Johnson
*Assistant Examiner*—Hau Phan
(74) *Attorney, Agent, or Firm*—Patterson, Thuente, Skaar & Christensen, P.A.

(57) ABSTRACT

An improved hinge system for pivotally coupling a skate lower portion to a skate upper cuff. The multi-hinge design incorporates a four link chain mechanism that greatly increases the number of design options for a hinged boot. The pivot axis defined by the four link chain can be designed to shift through a path of travel that generally coincides with the path of travel of the anatomical pivot axis defined by the user's foot and leg. The upper cuff and boot lower portion account for two of the four links of the four link mechanism. The other two links are either rigid bars with pin connections on both the upper cuff and the lower portion, or roller links with a pin connection to the upper and a slot like sliding surface on the lower portion. A slider link can be substituted for the roller and a slide surface can be substituted for the slot.

3 Claims, 11 Drawing Sheets

U.S. PATENT DOCUMENTS

| | | | | |
|---|---|---|---|---|
| 4,611,414 | A | | 9/1986 | Vogel |
| 4,809,686 | A | | 3/1989 | Crane |
| 5,065,533 | A | | 11/1991 | Paris |
| 5,143,387 | A | | 9/1992 | Colla |
| 5,171,033 | A | | 12/1992 | Olson et al. |
| 5,192,099 | A | | 3/1993 | Riutta |
| 5,193,294 | A | | 3/1993 | Pozzobon et al. |
| 5,232,231 | A | | 8/1993 | Carlsmith |
| 5,280,930 | A | | 1/1994 | Smathers et al. |
| 5,323,548 | A | | 6/1994 | Vogel |
| 5,329,707 | A | | 7/1994 | Chaigne et al. |
| 5,374,070 | A | * | 12/1994 | Pellegrini, Jr. et al. . 280/11.214 |
| 5,397,138 | A | | 3/1995 | Mangelsdorf |
| 5,403,021 | A | | 4/1995 | Shifrin |
| 5,486,012 | A | | 1/1996 | Olivieri |
| 5,487,552 | A | * | 1/1996 | Daoust ..... 280/11.214 |
| 5,517,771 | A | | 5/1996 | Paris et al. |
| 5,551,711 | A | | 9/1996 | Mangelsdorf |
| 5,947,487 | A | * | 9/1999 | Keleny et al. ..... 280/11.36 |

* cited by examiner

MULTI-HINGED SKATE AND METHODS FOR CONSTRUCTION OF THE SAME

CROSS REFERENCE TO RELATED APPLICATIONS

This is a Continuation of application Ser. No. 09/435,972 filed Nov. 8, 1999 now U.S. Pat. No. 6,431,550; which is a Continuation of application Ser. No. 08/820,588 filed Mar. 19, 1997, abandoned which in turn claims the benefit of Provisional Application No. 60/013,681 filed Mar. 19, 1996.

TECHNICAL FIELD

This invention pertains to boots for skates. In particular, it pertains to an improved hinge system connecting the lower boot to the upper boot cuff of an ice or in-line skate.

BACKGROUND ART

Skate boots for ice skates or in-line land based skates are well known. The majority of conventional skate boots are made from molded synthetic resins. Traditional molded in-line skates, as illustrated by FIG. 1, include a single pivot axis between the lower boot (which receives and constrains a foot) and an upper cuff (that grips the lower leg). The pivot axis is often a rivet-type connection on each side of the boot, providing a joint located in the vicinity of the anatomical ankle joint.

Conventional boots allow for rotation of the ankle, called flexion—extension-extension (shown by the curved arrow in FIG. 1). The boots are stiff in the lateral direction to provide support for maneuvering during skating. Unfortunately, the single pivot is difficult to locate exactly at the ankle joint, which is understood by those skilled in biomechanics to lie generally along an axis through the bony protuberances on the side of the ankle. The amount of force required to move the lower leg (the tibia) with respect to the ankle about this pivot axis during the skating motion (flexion—extension) can accordingly be more than it would otherwise be. The material of the boot must often be deformed to obtain a full range of motion for the user's ankle.

To complicate the problem, the anatomical pivot joint actually "floats" as the angle between the foot and the lower leg changes in the flexion—extension motion. More particularly, neither the lower leg nor the foot are made up of a single bone structure, and the connection between the foot and lower leg is more complicated than that of a simple hinge. The anatomical pivot point accordingly shifts in relationship to the axis through the bony protuberances on the side of the ankle as the angle of the foot relative to the lower leg shifts. A boot pivot axis created by a rivet-type connection, however, is fixed in the position of the rivet.

Another disadvantage of using the current rivet-type technology is that all of the load transferred at the pivot joint is concentrated at the pivots. The material around these pivots on both the upper cuff and the lower boot must accordingly be built up. While the extra material resists unwanted boot deflection due to longitudinal, lateral and torsion loads, it also results in more costly manufacture, heavier boots and concern for long term fatigue problems.

There are other problems and limitations with the current boot technology. The cuff must extend low enough to reach under the pivot axis, as well as extend high enough to grip the lower leg at a height that provides an adequate and comfortable lever arm. The lower boot must extend high enough above the pivot axis to support the pivot loads. Thus the cuff and lower boot have size and load requirements that add to the weight of the boot, add to the cost of manufacture, and adversely impact heat dissipation.

In fact, the design requirements of the single hinge approach to the flexion—extension issue restrict the number of options available to a boot designer. Once the cuff and lower boot height and weight considerations are met, there is little room for creative, alternative boot designs.

Most in-line skates have a rear mounted brake pad fixed to the lower boot behind the rear wheel. Braking occurs when the skater lifts the front of the skate off the rolling surface to engage the brake pad with the surface. More recently, movable brake mechanisms have been introduced, such as the two link chain extending between the cuff and the rear wheel comprising the brake depicted in FIG. 1. The rotation of the cuff clockwise relative to the boot (which is accomplished by the skater sliding a foot forward along the road surface while keeping the wheels on the road) will bring the brake pad in contact with the road surface. A shortcoming of the two link brake system, however, arises because two extra links must be added to the boot cuff and lower boot to realize the braking function. Also, the mechanical advantage of the two link brake is limited and nearly constant during braking.

A skate that would reduce the total weight of the boot, reduce the cost of manufacture, reduce the effort to rotate the ankle in flexion—extension during skating, and reduce the molded material surface and associated heat build up, would be a decided improvement to conventional designs. A new design that could incorporate flexures (living hinges) as substitutes for riveted joints would further reduce manufacturing costs. A new skate design would advantageously increase design options and should provide the ability to customize boots for a single person or a grouping of individuals based on leg, ankle and foot anatomy, and other preferences such as boot weight, anticipated use of the skates (recreational, racing, hockey, tricks, etc.), and the ankle strength of the user. Finally, an integrated brake design that avoided the problems of adding more comlexity to the standard boot and limited control of the mechanical advantage would provide lower cost and safety, as well as other advantages over conventional systems.

SUMMARY OF THE INVENTION

The problems outlined above are in large measure addressed by the multi-hinged skate in accordance the present invention. The improved hinged system hereof does away with the traditional single jointed connections between the lower portion of the boot and the upper cuff of the boot, and presents in their stead several alternative forms of multi-link hinges that constrain the cuff movement relative to the lower boot. The method for constructing the multi-hinged skates can incorporate actual anatomical measurements into the design procedures, to provide for individually customized hinged systems. The multi-hinged design distributes the load between the boot cuff and boot lower portion, reducing individual pin loads as compared with a single hinged design, and provides for multiple design variations. The multi-hinged design hereof also provides for increased ventilation for cooling. The multi-hinge design incorporates a four link chain mechanism to control the motion between the upper cuff and the lower boot. The upper cuff and the lower boot account for two of the four links of the four link mechanism. The other two links are either rigid bars with pin connections on both the upper cuff and the lower portion, or roller links with a pin connection to the upper and a slot like sliding surface on the lower portion.

One may also substitute a slider link for the roller and slide surface for the slot. The pin connection to the roller can be removed. The four link chain mechanism provides multiple advantages over the traditional, single hinge joint.

DESCRIPTION OF THE PREFERRED EMBODIMENTS

Figure 1:
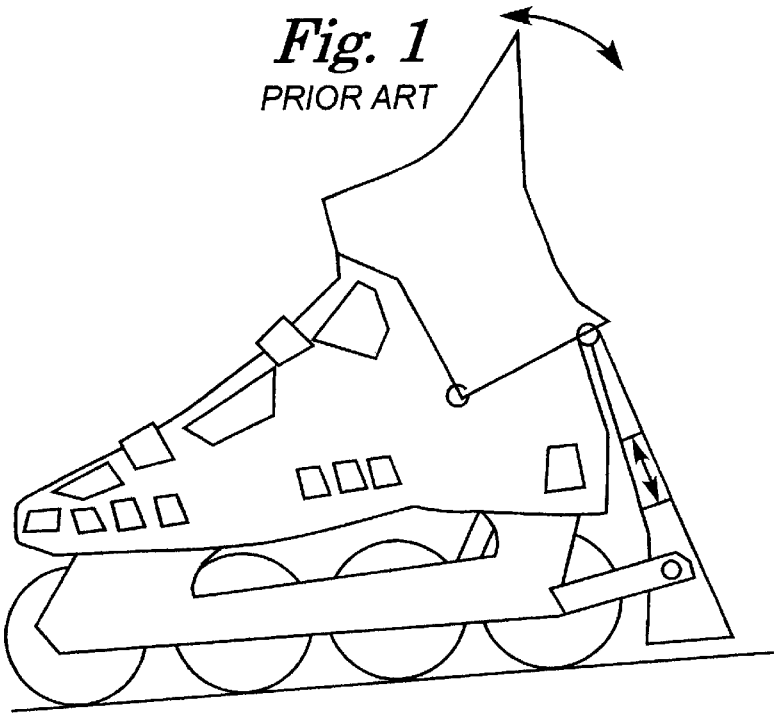
Fig. 1 PRIOR ART
FIG. 1 is a side elevational view of a prior art skate including a single rivet hinge and a two link brake system.
Figure 2:
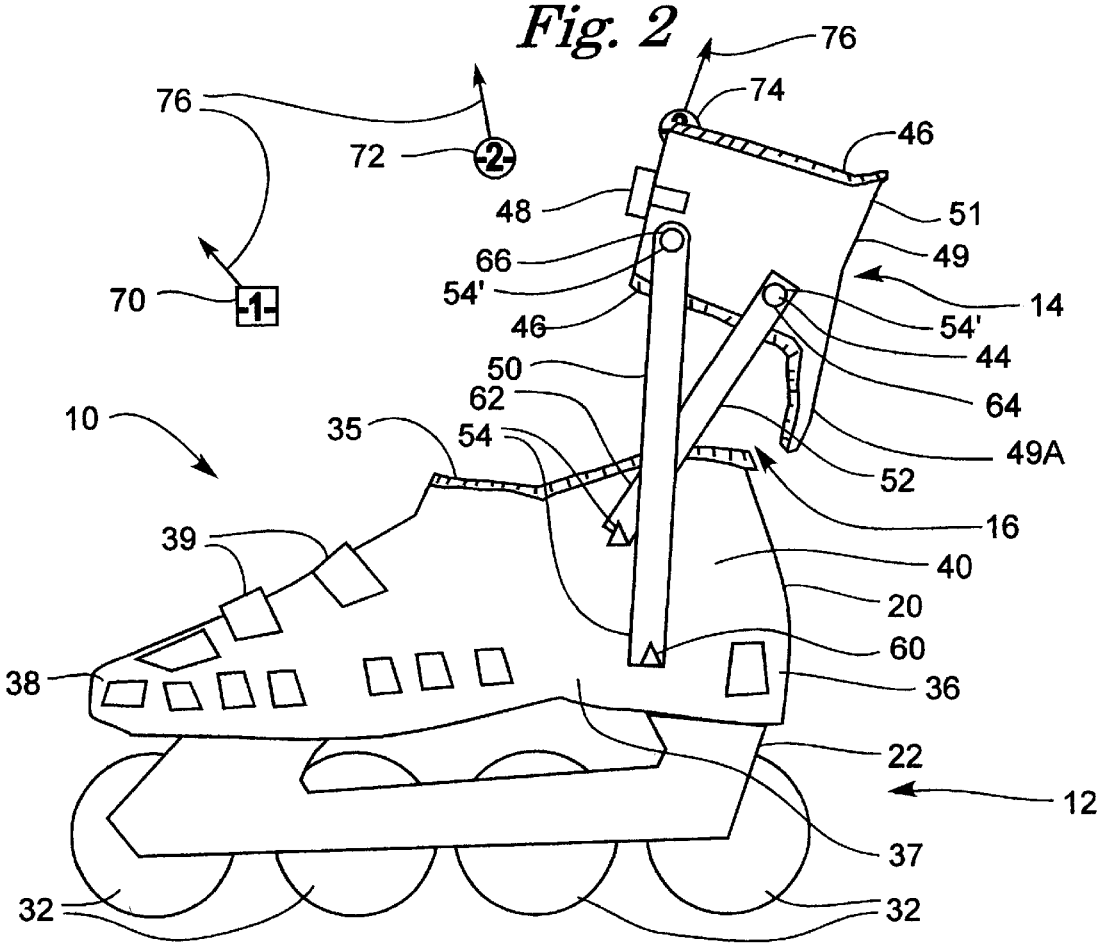
FIG. 2 is a side elevational view of a skate according to the present invention depicted in the neutral (extended) position.

Referring now to the drawings, a skate boot 10 is illustrated in FIG. 2, having a lower portion 12, an upper cuff and an intermediate portion 16.

The lower portion includes an undercarriage and either rollers 32 for an in-line skate application or a blade (not shown) for an ice skate use. Lower portion also includes inner padding 35, a heal section 36, a midsection 37, a toe section 38, one or more lower buckles 39 and a lower attachment section 40. The lower attachment section 40 includes lower attachment points 54. In the first embodiment of the present invention shown in FIGS. 2 and 3, lower attachment points 54 consist of revolute joints 60, 62.

The upper cuff 14 includes an outer surface 51, an upper attachment section 44, inner padding 46, an upper buckle 48, a rear portion 49 and may include a downwardly extending Achilles tendon portion 49A. The upper attachment section 44 includes upper attachment points 54'. Upper attachment points 54' consist of revolute joints 64, 66 in the first embodiment of the present invention.

Intermediate portion 16 includes a pair of rigid members 50, 52 on each of the medial and lateral sides of the boot, that connect between lower portion 12 and upper cuff 14.

The lower boot portion 12 holds the skater's foot in firm contact with skate boot especially the skater's heal, ankle and toe section, to help transfer desired skating forces and torques to the undercarriage 22 and wheels 32 or blade. The lower portion 12 is intended to be made of molded plastic based on methods well known in the art, but other materials or composites may also be used. There are many options for the shape of the lower portion 12, particularly because the present invention is not restricted to a single hinged connection between the lower boot and the upper cuff. The lower boot can be reduced in size and weight as compared to prior art molded lowers, due to the innovative method of connecting an upper cuff to the lower portion.

The lower attachment section 40 of the first embodiment has two lower attachment points 60, 62 that serve to transfer the loads from the upper cuff 14. As described in detail below, there are many permissible locations for lower attachment points 54, providing multiple options to the designer for shaping the lower portion 12, while meeting goals of lower weight, greater user comfort, reduced material volume, reduced manufacturing cost, reduced heat build-up, lower aerodynamic drag and improved appearance of skate boot 10.

The lower portion 12 includes one or more buckles 309 that allow the foot to be inserted into and be secured in the lower portion 12. The location and number of buckles is governed by the size of lower portion 12 and the loads required to keep the skaters foot secured in the lower portion 12. It will be understood that lower buckles may be replaced with hook and pile attachments (or laces and eyelets) as are well known in the art.

The upper cuff 14 serves to comfortably grip the lower leg of the skater while transferring the motion and forces of the upper leg relative to the foot into skating motion. The outer surface 51 of upper cuff 14 serves as a rigid member that keeps its shape under load and impact so as to protect the lower leg, but at the same time have low weight with respect to prior art upper cuffs. The outer surface 51 may be made of molded plastics or equivalent. The optional Achilles tendon portion 49A in the rear protects that part of the leg.

The upper cuff 14 includes one or more upper buckles 48 that are intended to allow the lower leg to be inserted into and secured to the upper cuff 14. In FIG. 2, upper buckle 48 is shown in the front of upper cuff 14 but the buckle can be located elsewhere on the upper cuff. The upper buckles may be replaced with hook and pile attachments (laces and eyelets) as are well known in the art. The inner padding 46 serves to form a comfortable interface between the lower leg of the skater and the upper cuff 14 to reduce rubbing or irritation of the leg.

The upper attachment section 44 includes upper attachment points 54'. Upper attachment points 54' consist of revolute joints 64, 66 that may assume a number of different locations. The loads on revolute joints 64, 66 are less than the loads on lower revolute joints 60, 62, since lower revolute joints 60, 62 have a torque arm load not found on upper revolute joints 64, 66. Thus the support material necessary for upper revolute joints 64, 66 is minimized and the subsequent additional weight to the upper cuff 14 is small.

The intermediate portion 16 of the first embodiment has been designed to guide upper cuff 14 relative to the lower portion 12 based on anatomical motion. The intermediate portion 16 includes rigid members 50, 52 that can have a variety of possible lengths. The shapes of rigid members 50, 52 are restricted only by the calculated locations of attachment points 54 and 54'. The three dimensional geometry of rigid members 50, 52 is accordingly a matter of the designer's choice, based on perceived force load, desired skate boot 10 shape and artistic look.

The four-bar linkage, such as employed in the present invention, is well known in the art as the smallest chain of links that can control the relative motion between two bodies. Lower portion 12 has rear first pin 60 and second pin 62 while upper cuff 14 includes second pin 64 and first pin 66. In this particular design, rigid member 50 extends between first lower pin 60 and first upper cuff pin 66 while rigid member 52 extends between second lower pin 62 and second upper cuff pin 64. These rigid members 50, 52 represent two of the four links of the four link chain. The other two links are the lower portion 12 and the upper cuff 14.

The locations of lower attachment points 54, upper attachment points 54' and rigid member 50, 52 are advantageously determined through kinematic synthesis. Methods of kinematic synthesis can determine critical dimensions of linkage mechanisms based on desired motion inputs.

More particularly, the locations of attachment points 54 and 54' and the lengths of rigid members 50, 52 can be determined by actual anatomical data that has been digitized (measured) from an actual person moving their leg relative to the ankle in flexion—extension motion, while the foot is constrained in a lower boot. Actual data from a typical skater is shown in TABLE 1, and was used in designing the embodiments depicted in FIGS. 2–7.

Table 1 represents the X, Y locations of points 70, 72 and 74 with respect to the rear wheel hub. The angles of the lower leg with respect to the horizontal axis pointing to the right and measured counter clockwise in the three measured positions are noted in the first column of Table 1. The first row of Table 1 is the most forward position 70, at an angle of 137 degrees. The second row is the measured values for the intermediate position 72, at an angle of 99 degrees. The third row is the measured values for the most extended position 74 at an angle of 75 degrees.

The LINCAGES software will convert the three prescribed planar design positions of Table 1 into many pairs of pins 60, 66 and 62, 64 that define rigid links 50 and 52, through non-linear mathematical relationships known in the art (e.g. *Mechanism Design: Analysis and Synthesis, Voumes* 1 & 2 by Erdman and Sandor published by Prentice Hall 1984, 1991 and 1997). The four bar linkage depicted in FIG. 2 was developed with the LINCAGES software. It consists of the lower portion 12 as link 1, rigid member 50 as link 2, rigid member 52 as link 3, and upper cuff 14 as link 4. The shape of the upper cuff 14 is arbitrary and does not effect the relative motion between the upper cuff 14 and the lower portion 12 except to possibly limit motion due to interference. The important kinematic outputs from the kinematic synthesis are pin locations 54, 54' and the first path tracer position 74.

A different subject would create data that would be similar to that in TABLE 1, but differences in the relative Cartesian positions X and Y and angular orientations is to be expected due to normal variations in the human population. Such differences between subjects can be accounted for in the boot design according to the present invention, as described below.

The planar motion data of Table 1 may be converted into attachment point locations 54, 54' on lower portion 12 and the upper cuff 14 receptively as well as rigid member 50, 52 lengths by methods of kinematic synthesis described in Mechanism Design textbooks such as *Mechanism Design: Analysis and Synthesis, Volumes I* & 2 by Erdman and Sandor published by Prentice Hall 1984, 1991 and 1997, incorporated herein by reference. In these design texts, graphical and analytical methods are described that take relative position data and convert that data into possible four link chains that control the motion between the coupler link (in this case upper cuff 14) and a base (in this case lower portion 12). Kinematic synthesis is a general methodology that has been applied to many products such as windshield wipers, assembly equipment and landing gear, but never before to the design of a boot hinge. A well known kinematic synthesis commercial software package called LINCAGES (@ University of Minnesota), developed in part by me, was used in the design of the embodiments shown in FIGS. 2–7, and is incorporated herein by reference. Graphical methods of kinematic synthesis could also be used in the design of the mechanisms of FIGS. 2–7, or other designs.

The intermediate portion 16 of the first embodiment has been designed to guide upper cuff 14 through the positions shown in TABLE I using pin connections only. The locations of attachment point 54, 54' determined through the LINCAGES software are shown in FIG. 2, along with rigid member 50, 52 relative lengths. It is understood that the same anatomical data can be met with many alternative attachment point locations 54, 54' and member 50, 52 lengths but there is a calculated but non-linear relationship between attachment point locations 54, 54'. The alternative solutions can be determined through kinematic synthesis, either with the LINCAGES program, or through graphical networks. The choice of these solutions is left to the designer. The three specified design positions 70, 72, and 74 listed in TABLE I are also shown in FIG. 2. The most forward (flexed) upper cuff 14 position 70, the most back (extended) position 74 and an intermediate position 72 are shown as boxes with arrows 76 identifying the measured relative angular orientations of the leg and upper cuff 30.

Lower portion 12 and upper cuff 14 have three dimensional geometry. For example, upper cuff 14 is generally a cylindrically shaped. Since the four-bar linkage moves in co-planar motion, and the desired motion data 88 of Table 1 is in the flexion-extension plane and the pins 54, 54' Must have parallel axes (along the flexion—extension-extension axis), pin connections 54, 54' Must be in the flexion—extension-extension plane. In this embodiment it would therefore be desirable to keep lower pin locations 54 away from the rear portion 36 of the lower portion 12 and to keep upper pin locations 54' away from either the front or rear portion 49 of the upper cuff 14 to avoid adding material to build-up for connecting surfaces for these pins.

The lower supports the expected load of ice or inline skating. Rigid links 50, 52 transfer loads from the upper cuff 14 to the lower portion 12. With two lower pins 60, 62, the load is distributed, rather than concentrated at the one pin of the traditional molded boot. The local cross section of the mold can accordingly be reduced compared with the traditional molded boot.

Figure 4:
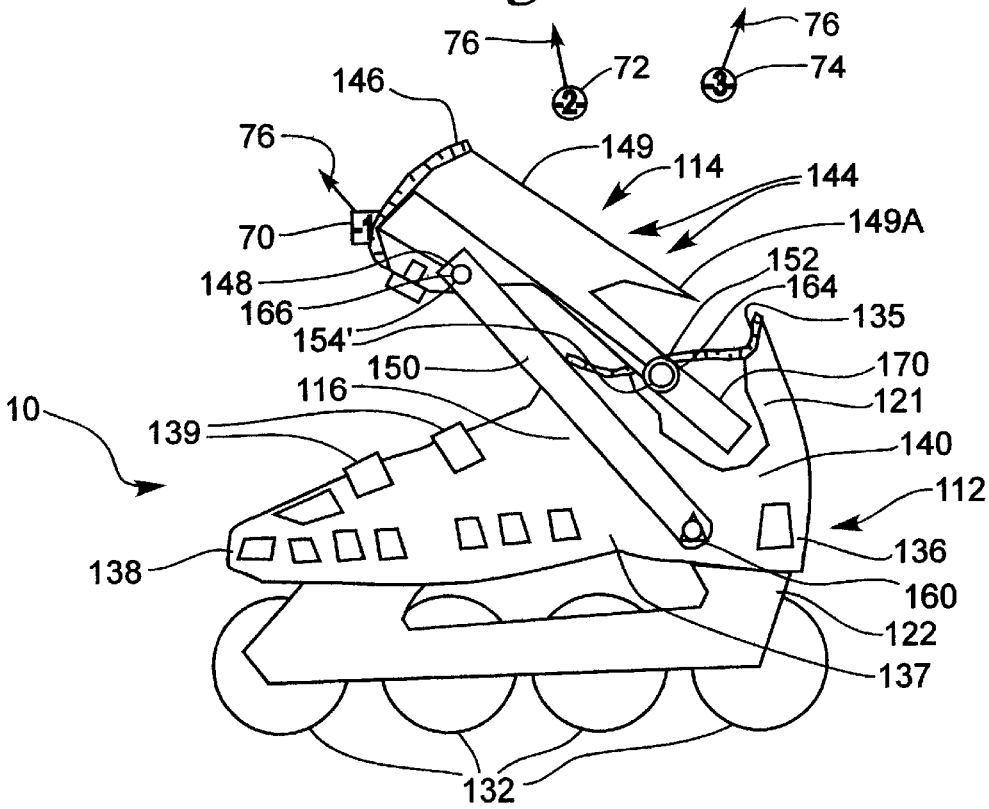
FIG. 4 is a side elevational view of a second embodiment of a skate in accordance with the present invention, with the skate upper depicted in the flexed position.
Figure 5:
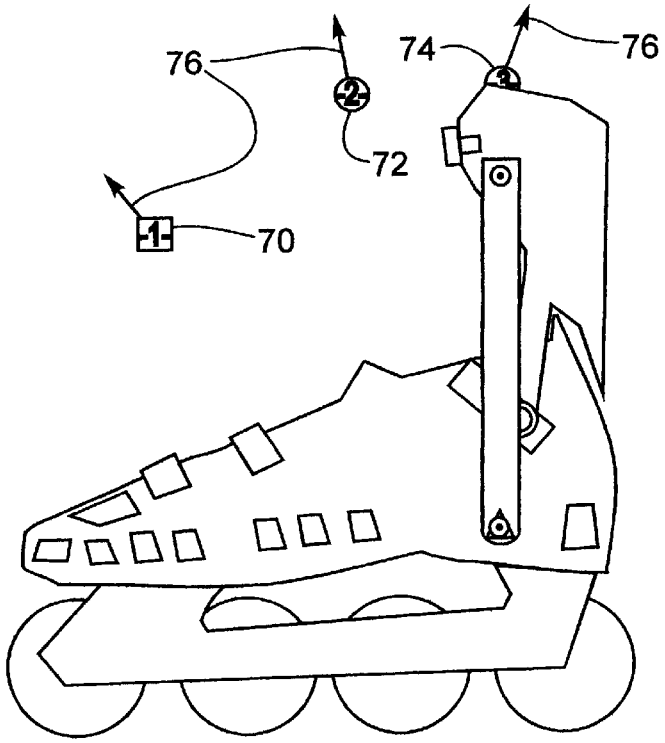
FIG. 5 is similar to FIG. 4, but with the upper depicted in the neutral position.

Referring to FIGS. 4 and 5, the second embodiment of the present invention includes a lower portion 112, an upper cuff 114 and an intermediate portion 116. The lower portion 112 includes an undercarriage 122 and either rollers 132 for an in-line skate application or a blade 134 (not shown) for an ice skate use. Lower portion 112 also includes inner padding 135, a heal section 136, a midsection 137, a toe section 138, one or more lower buckles 139 and a lower attachment section 140. In the second embodiment of the present invention, the lower attachment section 140 includes one lower revolute joint 160 on each side of the boot and a slot 170 (shown in FIGS. 4, 5 in the cut away section 121 of lower attachment section 140) on each side of the boot.

The upper cuff 114 includes an upper attachment section 144, inner padding 146, an upper buckle 148, an outer surface 149 and may include an Achilles tendon portion 149A. The upper attachment section 144 includes upper attachment points 154'. Upper attachment points 154' consist of revolute joints 164 and 166.

Figure 16:
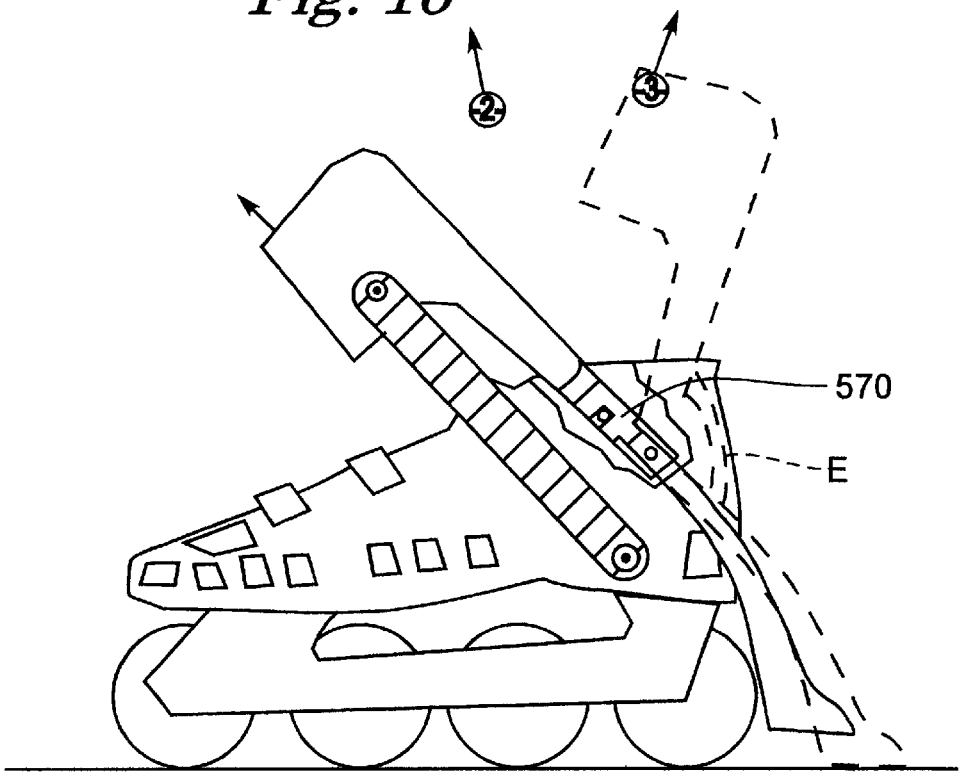
FIG. 16 is a side elevational view of an eighth embodiment of a skate in accordance with the present invention, with the skate depicted in the flexed position, and with phantom lines depicting the upper cuff in the braking position.

Intermediate portion 116 includes an identical pair of rigid members 150 on the medial side and the lateral side of the boot that connect between lower portion 112 and upper cuff 114. Intermediate portion 116 also includes a roller 152 on each side of the boot. It is recognized that the rollers 152 may be replaced by sliders or equivalent. For example, FIG. 16 shows a slider 570 that replaces roller 152 in FIGS. 4 and 5. The roller 152 and slider 570 can guide the rear base of the upper cuff in slot 170 in the same fashion.

Similar to the above described first embodiment, the lower portion 112 holds the skaters foot in firm contact with skate boot 10, and transfers desired skating forces and torques to the undercarriage 122 and wheels 132 or blade 134. The lower attachment section 140 of the second embodiment differs from the first embodiment in that it has one lower attachment point at lower revolute joint 160 and one slot 170 on each side for receiving, the load transferred from the upper cuff 114. There are a variety of permissible locations for lower revolute joint 160 and location of slot 170 that could be used by the designer in meeting the goals of lower weight, greater user comfort, reduced material volume, reduced manufacturing cost, reduced heat build-up, lower aerodynamic drag and/or artistic look of skate boot 10.

The lower portion 112 includes one or more buckles 139 that allow the foot to be inserted into and secured to the lower portion 112. The location and number of buckles would be governed by the size of lower portion 112 and the loads required to keep the skaters foot secured in the lower portion 112. It is understood that lower buckles may be replaced with hook and pile connectors or laces and eyelets are is well known in the art.

The upper cuff 114 comfortably grips the lower leg of the skater and transfers the motion and forces of the upper leg relative to the foot into skating motion. The outer surface 149 of upper cuff 114 serves as a rigid member that keeps its shape under load and impact, protecting the lower leg but at the same time having low weight with respect to prior art upper cuffs. The outer surface 149 may be made of molded plastics or equivalent and may include an Achilles tendon portion 149A in the rear to protect that part of the leg.

The upper cuff 114 includes one or more upper buckles 148 that are intended to allow the lower leg to be inserted into and secured to the upper cuff 114.

In FIG. 4, upper buckle 148 is shown in the front of upper 114 but the buckle 148 can be located elsewhere on the upper cuff. The upper buckles may be replaced with hook and pile connectors or laces and eyelets as are well known in the art. The inner padding 146 serves to form a comfortable interface between the lower leg of the skater and the upper cuff 114 to reduce rubbing or irritation of the leg.

The upper attachment section 144 includes upper attachment points 154'. Upper attachment points 154' consist of revolute joints 164, 166. The location of the joints can vary, as described in detail below.

The intermediate portion 116 of the second embodiment is designed to guide upper cuff 114 relative to the lower portion 112 based on anatomical motion. The intermediate portion 116 includes rigid member 150 that has a variety of possible lengths and a roller 152 that has a variety of possible positions. The shape of rigid member 150 is restricted only by the selected locations of pins 160 and 166. The three dimensional geometry of rigid member 150 is accordingly left to the designer based on perceived force load, boot shape and artistic look.

The locations of pins 160, 166, slot 170 as well as rigid member 150 are again selected by methods of kinematic design called kinematic synthesis. Lower portion 112, rigid member 150, upper cuff 114 and roller 152 make up a four link chain of links which is different in form from that of the first embodiment. The form of the four link chain is sometimes called a crank-slider mechanism. The four bar chain of the second embodiment and depicted in FIGS. 4 and 5 was determined from the same anatomical data of Table 1.

Planar motion data 88 may be converted into pin locations 160, 166 that define the end positions of rigid member 150 and the location of slot 170 by methods of kinematic synthesis described in Mechanism Design textbooks such as *Mechanism Design: Analysis and Synthesis, Volumes I & 2* by Erdman and Sandor. Either the LINCAGES software or graphical methods of kinematic synthesis can be used to determine pin and slot locations, and rigid member lengths.

The intermediate portion 116 of the second embodiment has been designed to guide upper cuff 114 through positions shown in TABLE 1 using pin and roller connections. The three specified design positions 70, 72, and 74 listed in TABLE 1 are also shown in FIGS. 4, 5. The most forward (flexed) upper cuff 14 position 70, the most back (extended) position 74 and an intermediate position 72 are shown as boxes with arrows 76 identifying the relative angular orientations of the leg and upper cuff 114.

The intermediate portion 116 includes an identical pair of rigid members 150 on the medial side and on the lateral side of the boot. A pair of rollers 152 on the medial side and the lateral side of the boot extend between the lower boot 112 and upper cuff 114. Rollers 152 are connected with pins 164 to the upper cuff 114 and have contact with the lower boot 112 in slot 170. Notice that the outside layer(s) of the lower 112 is cut away at line 121 to expose slot 170 in FIGS. 4, 5. The method of connection between members 150 and lower 112 and upper cuff 114 is by pins or rivets 160, 166.

The locations of pins 160 166, the lengths of rigid members 150, the location of rollers 152 and the angle of slot 170 are determined according to the anatomical data of TABLE 1. In the depicted version of the second embodiment, the slot is straight and inclined. Roller 152 and slot 170 are kinetically equivalent to a very long rigid link that would have an equivalent lower pin connection in the direction perpendicular to the slot direction and a large distance away from the boot. For equivalent lower pin connections that are twenty or more times the wheel 132 diameter, the slot will be very straight. For lower pin connections less than ten times the wheel 132 diameter, the slot will be more curved such that the radius of curvature is the length of the equivalent rigid link. The shape of the upper cuff 114 is arbitrary and does not effect the relative motion between the upper cuff 114 and the lower boot 112 except to possibly limit motion due to interference. The important kinematic outputs from the kinematic synthesis are pin locations 160, 166, roller 152 location, slot 170 angle and the first path tracer position 74.

In this second embodiment, rigid link 150 and roller 152 will transfer loads from the upper cuff 114 to the lower 112. The roller 152 and slot 170 are intended to carry most of the load so that the rigid links 150 may be designed accordingly and pin connection 160 will not have as much load.

Figure 6:
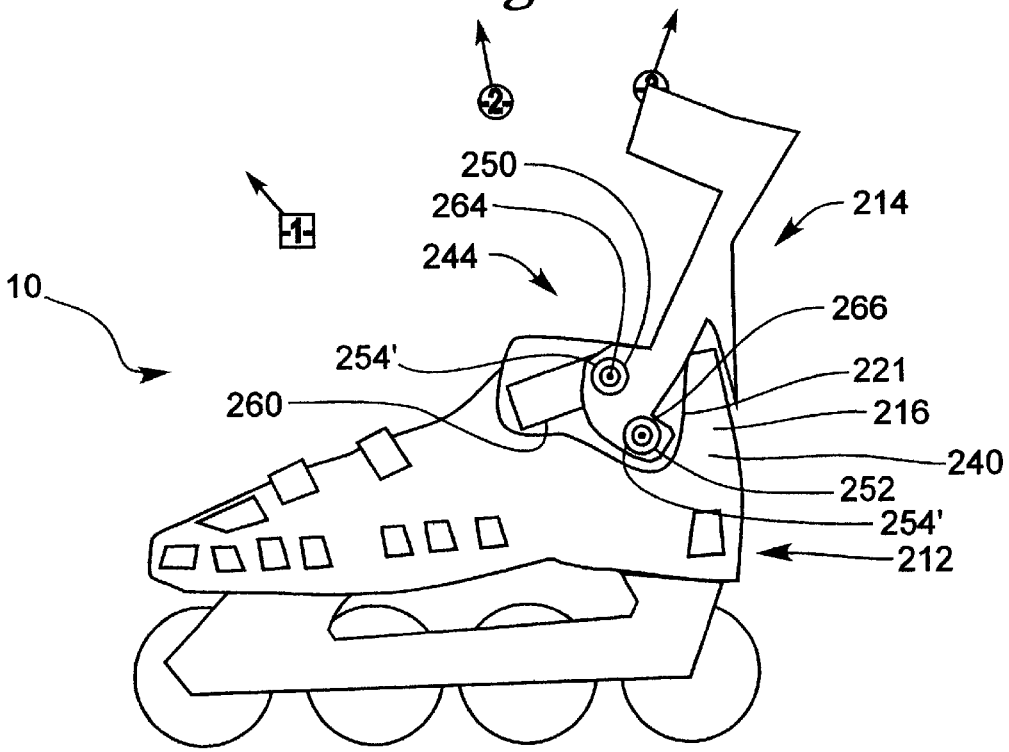
FIG. 6 is a side elevational view of a third embodiment of a skate in accordance with the present invention, with the skate upper depicted in the neutral position.
Figure 7:
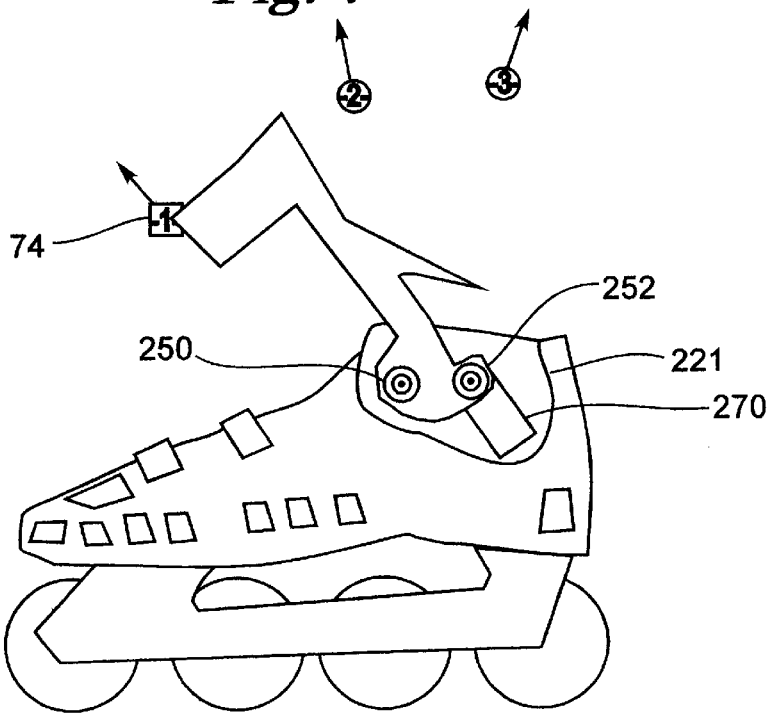
FIG. 7 is similar to FIG. 6, but with the upper depicted in the flexed position.

Referring to FIGS. 6 and 7, the third embodiment includes a lower portion 212, an upper cuff 214 and an intermediate portion 216. The most significant difference between the third and second embodiment is that the lower attachment section 240 includes upper attachment points 254' on each side of the boot consisting of slots 260 and 270 (shown in FIGS. 6, 7 in the cut away section 221 of lower attachment section 240) on each side of the boot.

The upper cuff 214 includes an upper attachment section 244 which includes upper attachment points 254'. Upper attachment points 254' consist of revolute joints 264 and 266.

Intermediate portion 216 includes rollers 250, 252 on each side of the boot. It is recognized that the rollers 250, 252 may be replaced by sliders or equivalent.

The lower attachment section 240 of the third embodiment includes slots 260, 270 that receive the load from the upper cuff 214 through the intermediate portion 216. There are many permissible locations of slots 260, 270 which can be selected through kinematic synthesis.

The upper attachment section 214 includes upper attachment points 254'. Upper attachment points 254' consist of revolute joints 264 and 266 that may assume a number of different locations.

The intermediate portion 216 of the third embodiment has been designed to guide upper cuff 214 relative to the lower portion 212 based on anatomical motion. The intermediate portion 216 includes rollers 250 and 252.

The locations of pins 264, 266, slots 260, 270 and rollers 250 and 252 are again selected through kinematic synthesis. Lower 212, upper cuff 214 and rollers 250, 252 make up a four-bar chain of links which is different in form from that of the first and second embodiments. The four bar chain of the third embodiment (sometimes called a double-slider mechanism) corresponds to the same anatomical data of TABLE 1. In the third embodiment depicted in FIGS. 6 and 7, the slots are straight and inclined. The rollers and slots are again kinematically equivalent to very long rigid links that would have equivalent lower pin connections in the direction perpendicular to the slot direction and a large distance away from the boot. The shape of the upper cuff 214 is arbitrary and does not effect the relative motion between the upper cuff 214 and the lower 212 except to possibly limit motion due to interference. Appropriate pin locations 264, 266, roller locations 250 and 252, slot 260, 270 locations and angles and the first path tracer position 74, as depicted in FIG. 7, can be determined through kinematic synthesis.

Rollers 250, 252 transfer loads from the upper cuff 214 to the lower boot 212. The load is accordingly shared and distributed. Slider joints or equivalent may replace rollers 250, 252.

Figure 8:
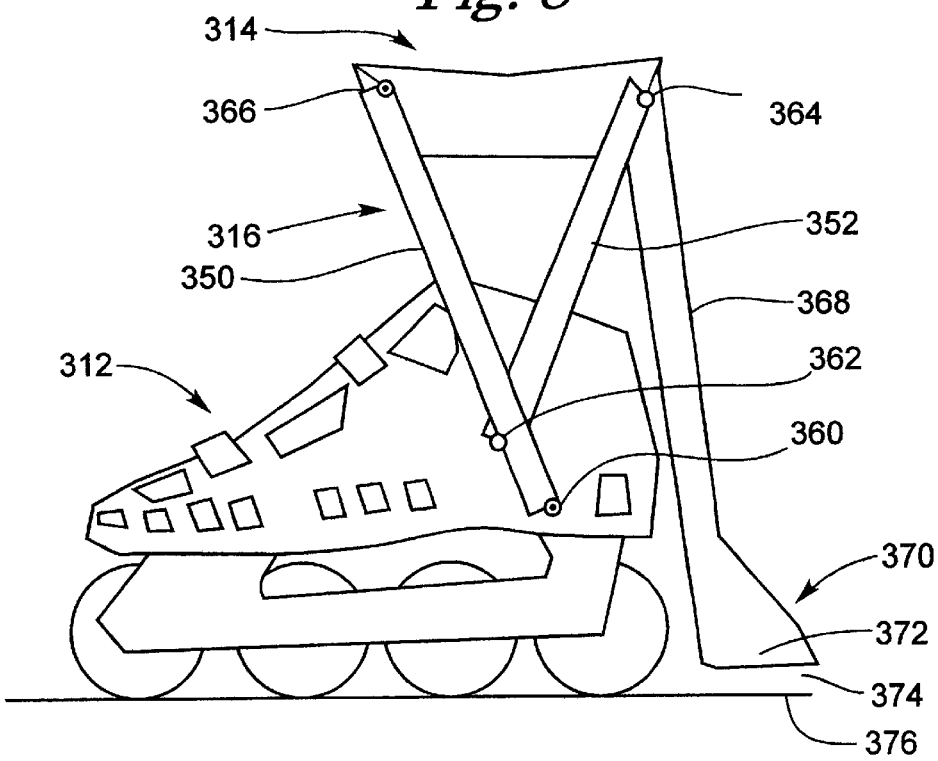
FIG. 8 is a side elevational view of a fourth embodiment of a skate in accordance with the present invention, with the skate depicted in the neutral position.
Figure 9:
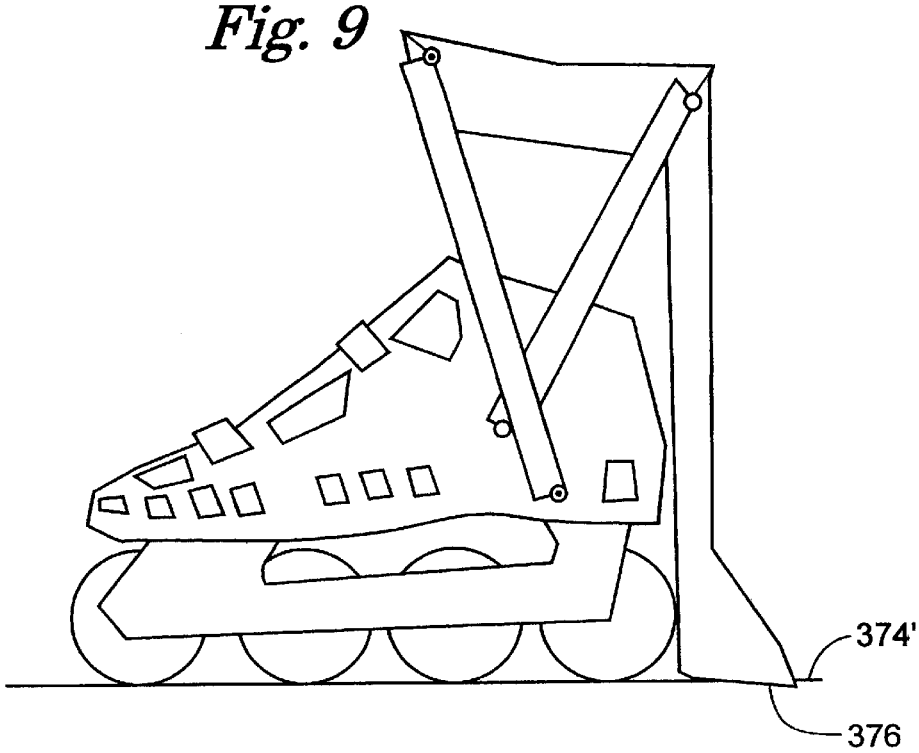
FIG. 9 is similar to FIG. 8, but with the skate depicted in the braking position.

A fourth embodiment of the boot design in accordance with the present invention is depicted in FIGS. 8 and 9. The fourth embodiment includes lower boot 312, upper cuff 314 and intermediate portion 316. Lower boot 312 includes lower attachment pivots 360, 362. The upper cuff 314 includes upper attachment pivots 364, 366, extension 368 and integral brake 370. The integral brake 370 has a brake pad 372, depicted in lower surface position 374 and 374' respectively, in FIGS. 8 and 9, with respect to ground 376.

Figure 3:
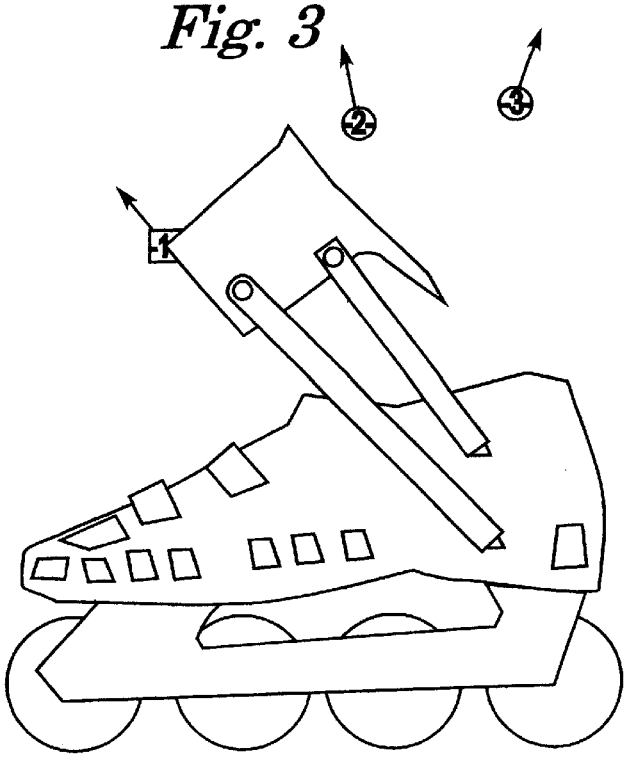
FIG. 3 is similar to FIG. 2, but with the skate upper depicted in the flexed position.

The four link chain depicted in FIGS. 8 and 9 is of the same type as introduced in FIGS. 2, 3, but with different dimensions. Upper cuff pivots 364 and 366 of FIGS. 8 and 9 correspond to, but are at different locations, as compared to upper cuff pivots 64 and 66 of FIGS. 2 and 3. Also, lower pivots 360 and 362 correspond to, but are at different locations, as compared to lower pivots 60 and 62. The pivots 360, 362, 364, and 366 generate a four link chain designed to control the motion of the upper cuff 314 relative to the lower boot 312. During the normal range of motion of the lower leg with respect to the foot while skating, brake pad lower surface 374 does not contact ground 376. Intentional rotation of the lower leg, and thus upper cuff 314 clockwise relative to the lower 312, however, (which is accomplished by the skater sliding their foot forward along the road surface while keeping the wheels on the road) will bring the brake pad lower surface 374' in contact with the ground 376, as depicted in FIG. 9.

Figure 10:
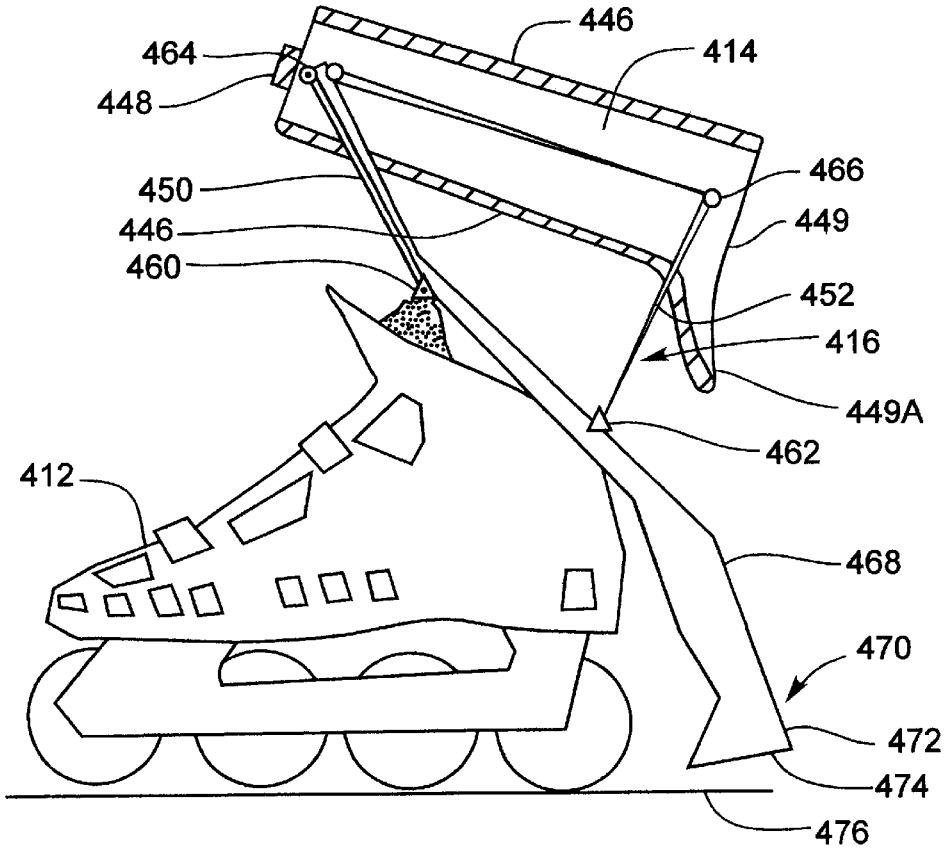
FIG. 10 is a side elevational view of a fifth embodiment of a skate in accordance with the present invention, with the skate depicted in the neutral position.
Figure 11:
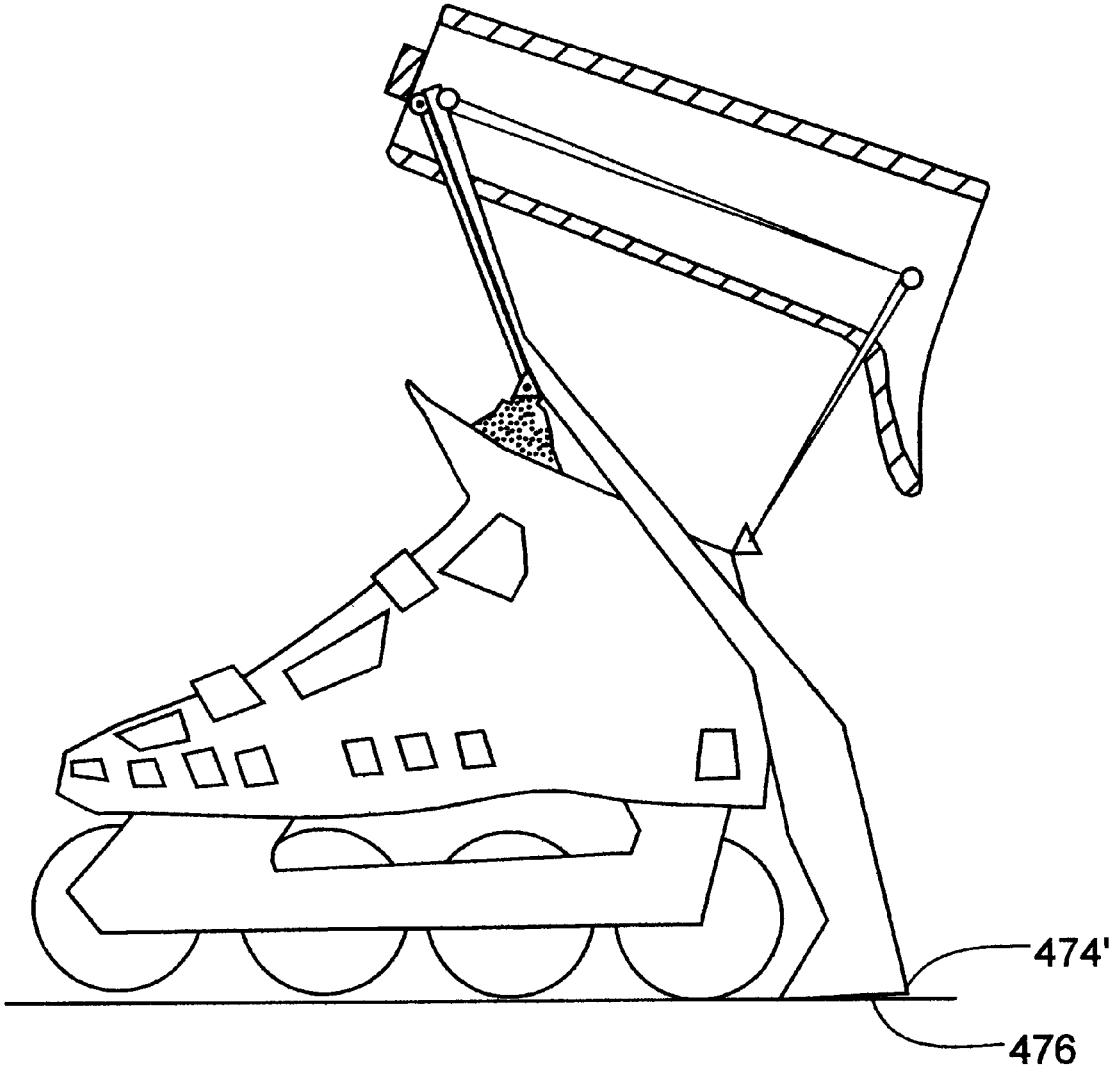
FIG. 11 is similar to FIG. 10, but with the skate depicted in the braking position.
Figure 12:
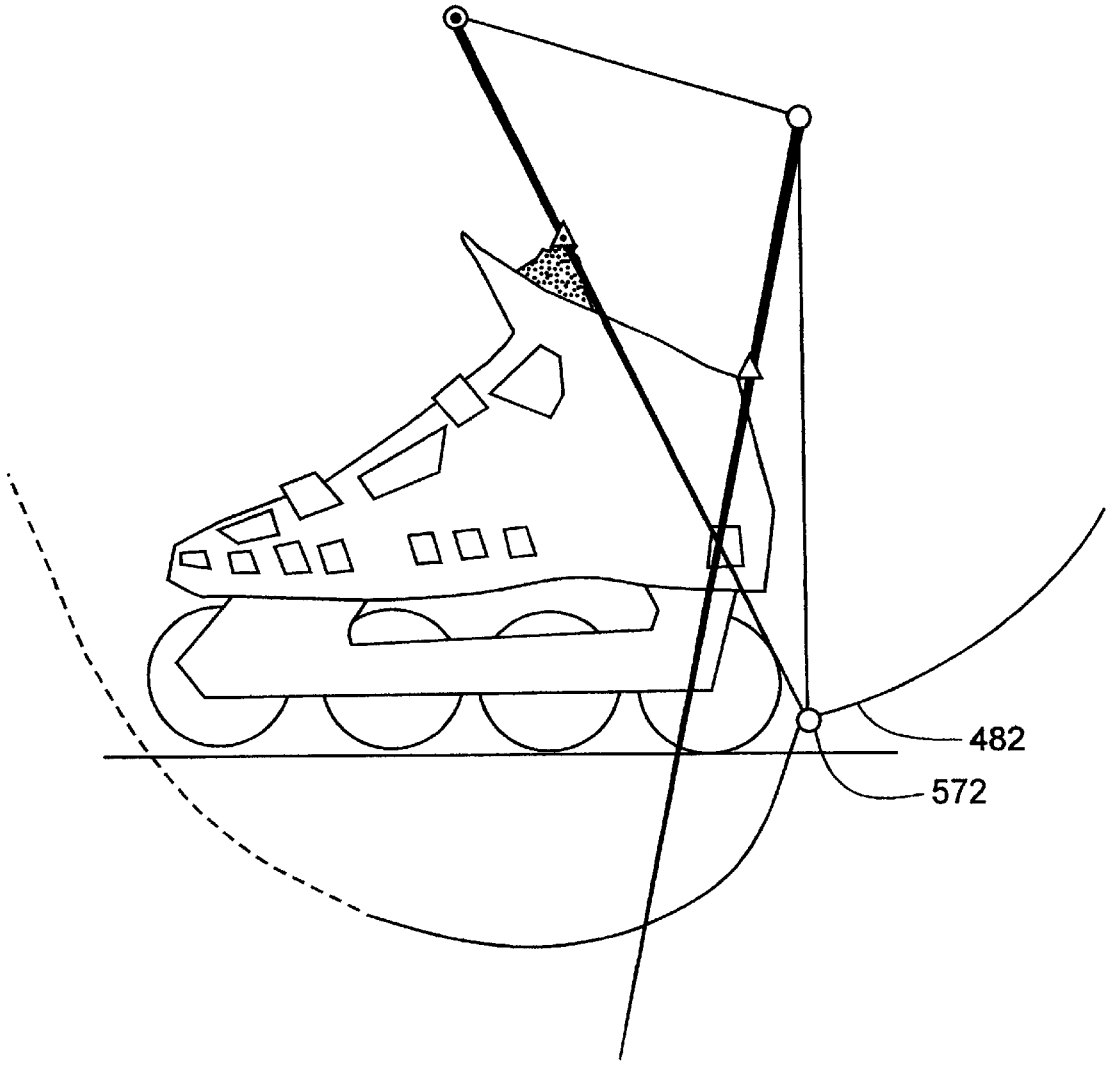
FIG. 12 is a schematic view of the skate of FIG. 11.

Referring to FIGS. 10, 11 and 12, a fifth embodiment of the boot design in accordance with the present invention includes lower boot 412, upper cuff 414, and intermediate portion 416. Lower boot 412 includes lower attachment pivots 460, 462. The upper cuff 414 includes upper attachment pivots 464, 466, buckle(s) 448, inner padding 446, rear portion 449, and may include Achilles tendon portion 449A.

The intermediate portion 416 includes rigid links 450, 452, extension 468 of rigid link 450, and integral brake 470 at the end of extension 468. The integral brake 470 is shiftable between lower surface positions 474 and 474', depicted in FIGS. 10 and 11 respectively, with respect to ground 476.

The four link chain shown in FIGS. 10–12 is of the same type as introduced in FIGS. 8, 9 and FIGS. 2, 3, but with different dimensions. Upper cuff pivots 464 and 466 of FIGS. 10–12 correspond to, but are at different locations, as compared to upper cuff pivots 64 and 66 of FIGS. 2 and 3. Also, lower cuff pivots 460 and 462 correspond to, but are at different locations, as compared to lower cuff pivots 60 and 62. The pivots 460, 462, 464, and 466 comprise a four link chain designed to control the relative motion of the upper cuff 414 relative to the lower boot 412. As the cuff is shifted by the lower leg clockwise with respect to the lower boot, the brake pad moves into contact with the ground (FIG. 11). Referring to the schematic depiction of FIG. 12, the four-bar chain depicted in FIGS. 10 through 12 presents a favorable motion trajectory (482) of the brake pad. The trajectory path of the tip 572 of the Coupler triangle represents the lower surface of the brake pad 472. Note that this path is nearly perpendicular to the road surface 476 as the brake pad approaches the road surface 476. As with previous embodiments, the embodiment of FIGS. 10 and 12 can be developed with standard kinematic synthesis, employing the LINCAGES software, or graphical analysis.

The path of travel of the edge of the brake pad can also be determined by other methods, such as the use of instant centers. The method of instant centers can also be useful in the design of multi-link hinges. More particularly, the orientation of the pairs of rigid links are designed specifically to simulate the anatomical ankle joint—the center of rotation between the cuff and the lower boot is designed to be essentially at the same location as the human ankle. By Kennedy's theorem (See *Mechanism Design: Analysis and Synthesis*, referred to above and incorporated by reference) the instant center of rotation is at the intersection of the lines between the pivots of the two links. The four pivot locations can be changed to locate the simulated ankle joint in a specified region, but only a finite set of combinations will be acceptable. As the cuff moves relative to the lower boot, the crossing point will move some. The movement of this simulated ankle joint can be selected to match the shifting of the anatomical axis, and can be selected to positively effect the mechanical advantage of the skater during braking.

Note that there have been two integral brake systems depicted, one in FIGS. 8, 9 and the other in FIGS. 10–12. In the first case, the brake is an extension of the upper cuff; in the second, the brake is an extension of one of the rigid links. The brake pad is connected to the forward-most link pairs 450 (one on each side of the boot). One reason for this is that the forward link moves at a higher angular velocity than cuff 414 and requires less cuff motion to engage the brake pad to the ground surface. The brake can be connected to any of the components that are moving with respect to the lower member. For example, the brake may also be connected to the roller (or slider) 164 of the embodiment in FIGS. 4, 5 or either roller (or slider) 250, 252 of the embodiment in FIGS. 6, 7. Note that, in each of these cases, as the upper cuff moves clockwise towards its neutral position, the direction of movement of the roller (slider) is toward the ground.

Figure 13:
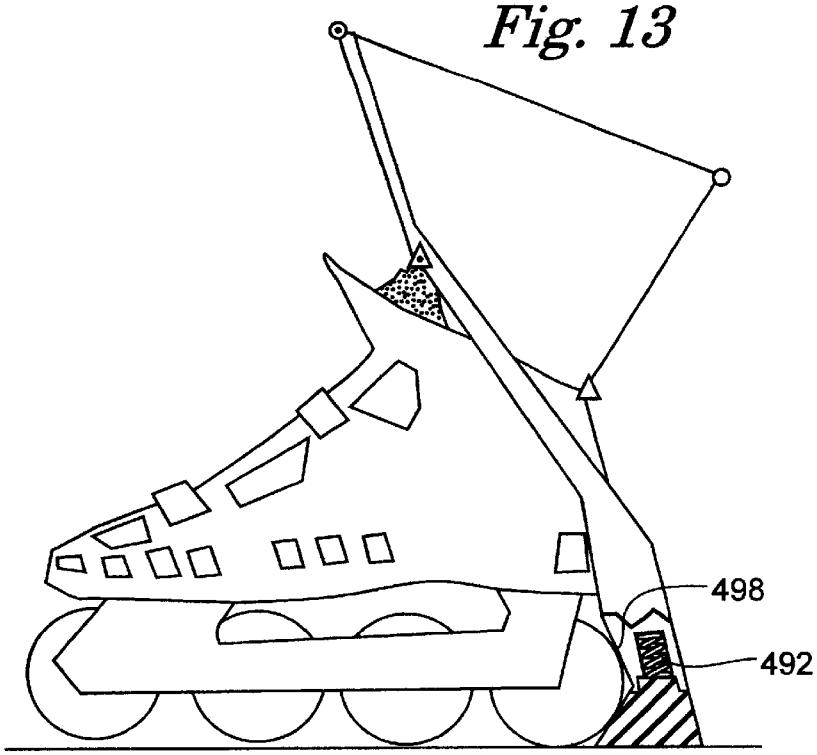
FIG. 13 is a side elevational view of a sixth embodiment of a skate in accordance with the present invention, with the skate depicted in the braking position.
Figure 14:
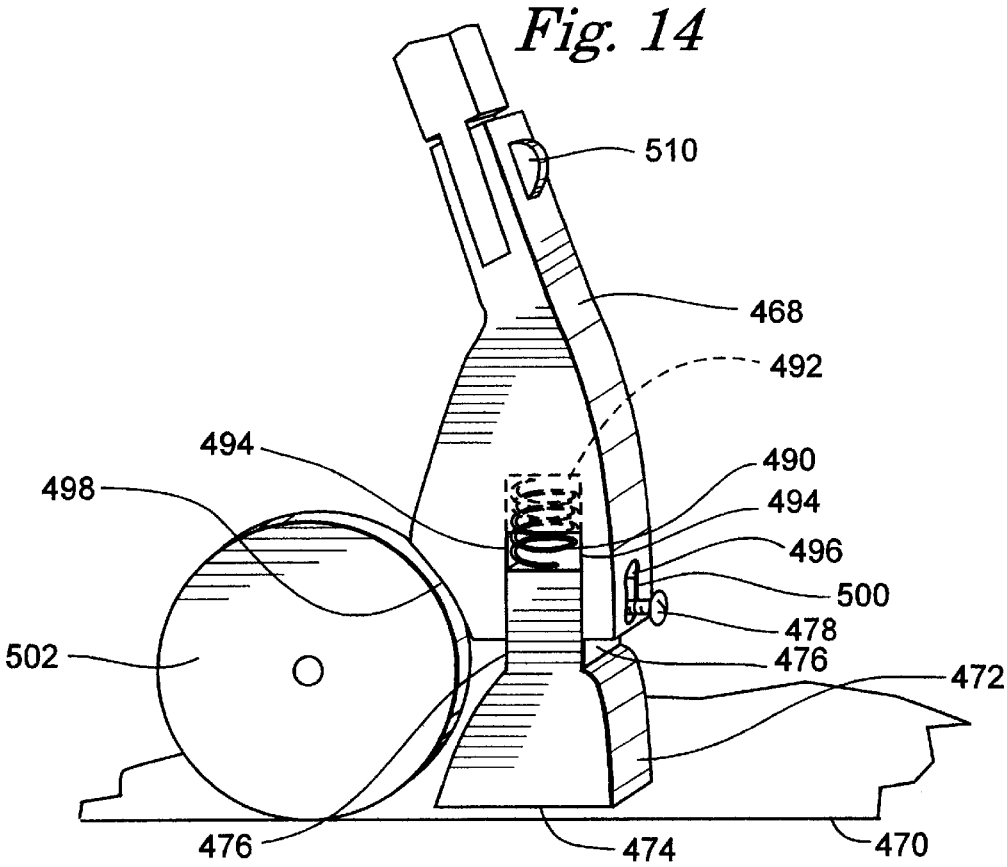
FIG. 14 is an enlarged, fragmentary view of an alternative brake construction.

FIGS. 13–14 depict a sixth embodiment of the boot in accordance with the present invention. The embodiment of FIGS. 13–14 includes a three step braking system that is actuated by clockwise movement of the upper cuff relative to the lower portion. FIGS. 13–14 depict the same multi-hinge design of FIGS. 10, 11 but with a more advanced multi-stage brake that could as well be incorporated into the other depicted embodiments. This embodiment includes extension arm 468, and brake pad 472. Extension arm 468 includes cavity 490, slot 496 and inner surface 498. Cavity 490 includes spring 492 and parallel surfaces—194. Slot 496 has a pair of interference nubs 500. Brake pad 472 includes lower surface 474, upper parallel slide surfaces 476 and screw 478.

The primary braking system is the same as has been described earlier: the extension arm 468 rotation is initiated by clockwise rotation of the upper cuff relative to the lower boot such that brake pad lower surface 474 comes in contact with the road surface 470. Extension arm 468, however, includes cavity 490 that houses spring 492 and, parallel surfaces 494 that accept brake pad 472. Brake pad 472 includes upper parallel slide surfaces 476, slidably received within extension arm parallel surfaces 494. Screw 478 is inserted into brake pad 472, fixing the brake pad 472 in the distal end of the extension arm 468 and against the force of spring 492. Screw 478 is initially inserted into lower section of slot 496 below a pair of interference nubs 500. During normal braking, spring 492 and nubs 500 hold the brake in the down position and provide enough normal force between the pad lower surface 474 and the road surface 470 for standard braking. The primary brake has compression spring 492 (or equivalent) plus nubs 500 between the extension arm 468 and the brake pad 472. When the skater requires quicker deceleration, more force on the upper cuff will continue clockwise rotation of extension arm 468. Spring 492 will compress and screw 478 will be forced past nubs 500 so that screw 478 will now be in the upper portion of slot 496. As this occurs, brake pad 472 will slide up into cavity 490 as upper parallel slide surfaces 476 slide inside extension arm parallel surfaces 494. This upward motion of brake pad 472 with respect to extension arm 468 shifts inner surface 498 into rear wheel 502. Thus there is an "emergency brake"in which further clockwise rotation of the upper cuff beyond the initial road contact position will bring part of the extension arm 468 into contact with rear wheel 502. This slows the rotation of rear wheel 502. The rear wheel 502 will still have some rotation (although slower than that of the other wheels and slower than that required for keeping up with the road velocity at the point of contact of the rear wheel 502). This reduced rotational velocity will cause skidding (and therefore dissipate kinetic energy and speed), but the wear on the rear wheel 502 will be distributed around its periphery and not cause a flat spot in the rear wheel 502 surface. Full force on the cuff in the clockwise direction, however, could be extended to freeze the rotation of rear wheel 502.

Inner surface 498 could alternatively come in contact with some other portion of the rear wheel assembly, such as part of the hub or the wheels rolling surface, for dissipation of kinetic energy.

The three step braking system described above includes: normal pressure on the upper cuff (which is accomplished by the skater sliding their foot forward along the road surface beyond the ankle motion required for normal skating) causing brake pad 472 to contact the road surface; further clockwise pressure that would trigger the extension arm 468 to contact with rear wheel 502 (but allow the rear wheel 502 to slowly rotate); and full clockwise rotation and that would completely stop the rotation of the rear wheel 502. The brake pad is located on an extension of one of the four-bar links. The link extension can also include a "thumb wheel"510 for extending the length of the link, to adjust for pad wear.

Figure 15:
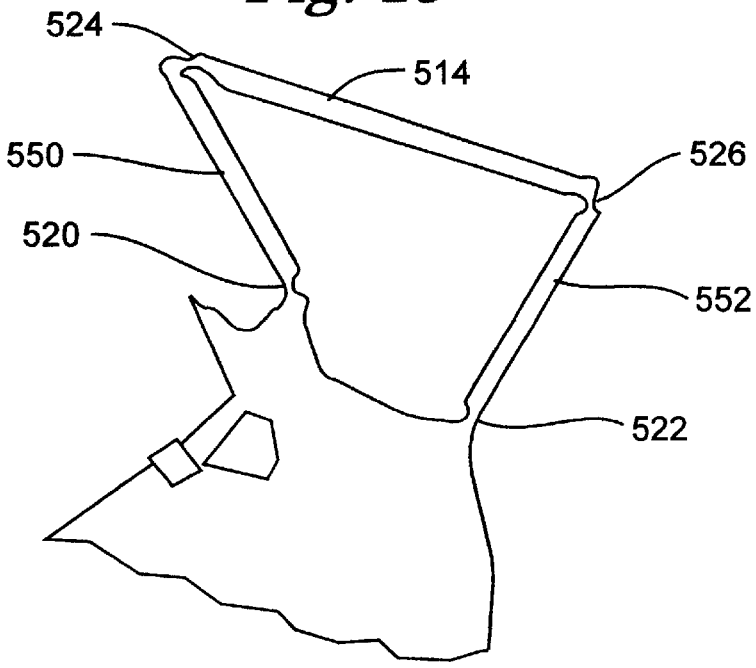
FIG. 15 is a fragmentary view of a seventh embodiment of a skate in accordance with the present invention, depicting an alternative method of creating revolute joints.

Referring to FIG. 15, a seventh embodiment of the present invention replaces one or more rivet type joints of the multi-hinge system with flexures. Since the relative rotations between the lower boot, the rigid links and the cuff are small, these joints can be fabricated as flexures (narrowed down portions in the mold) that concentrate the bending at the desired. FIG. 15 depicts a portion of a skate boot similar to that depicted in FIGS. 10 through 12, but with the revolute joints 460, 464, 466, and 462 replaced by flexures 520, 524, 526, and 522. The kinematic dimensions of the four link chain defined by the revolute joint 460, 464, 466, and 462 locations are identical, it being understood that the centers of the narrowed down sections of flexures 520, 524, 526, and 522 serve as the equivalent rivet locations. The advantages of this seventh embodiment include low cost, and an automatic return to the neutral position (if desired) when the force of the lower leg on the upper cuff is removed. Low cost is realized in part because a single mold can be employed for the three sections of the boot: the upper cuff, the lower boot and the intermediate section. Also, assembly cost and the extra cost of the rivets is saved.

FIG. 16 depicts an eighth embodiment of the present invention wherein a brake is incorporated within a slider link. The embodiment of FIG. 16 has the same linkage geometry as depicted in FIGS. 4 and 5. As the upper cuff rotates clockwise, the slider moves diagonally downwardly and to the right, from the perspective of FIG. 16. The brake pad is accordingly brought into contact with the road surface. A spring or more rigid contact could be positioned between the cuff link and the break to provide greater torque on the brake pad. This is particularly the case since the angle between the upper cuff and the brake link decreases as the ankle extends towards the braking position. Thus a compression or torsional spring would store force to impart a transfer of load between the upper cuff and the brake link. Also, an extension of the upper cuff could make contact with the brake link to provide additional torque to the brake link, such as is indicated at E in FIG. 16.

Figure 17:
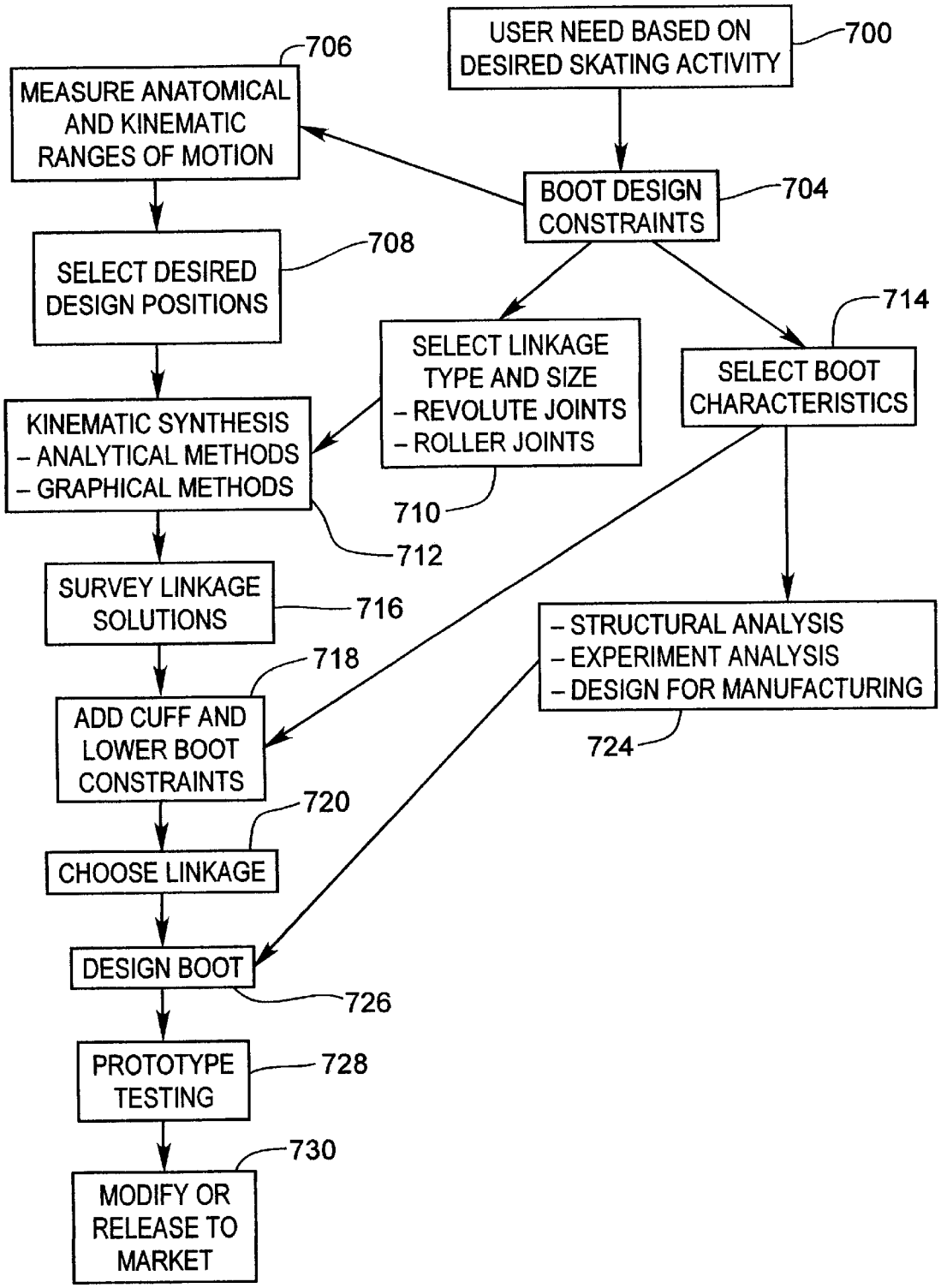
FIG. 17 is a flow diagram depicting a boot design procedure in accordance with the present invention.

FIG. 17 is a flow diagram that Outlines a multi-hinge skate boot design procedure. The first step 700 is to determine end user needs based on the specific skating activity such as recreational in-line skating or street hockey. From this knowledge, the designer determines boot design constraints in second step 704 such as desired ankle movements along the three orthogonal axes and stiffness of the boot hinge system. The next step 706 is to measure actual anatomical motion of one or more humans and determine the resulting ankle range of motion in the specific skating activity that the boot is being designed for. From this information, step 708 requires selection of prescribed design positions (e.g. design positions 70, 72, 74 along with design angles 76 to create planar data 88 similar to Table 1). The selection of link joint types (pin, roller or slider) in step 710 is based on previous deliberations such as the desired skating activity in step 700 and determination of boot constraints in 704. In some cases, a multi-hinged mechanism with pin joints may make sense where in other cases rollers or sliders may be more appropriate.

Next kinematic synthesis (step 712) is carried out by either analytical (such as using the LINCAGES software as described above) or graphical methods. Based on the kinematic synthesis method chosen, step 716 then includes surveying a number of potential solutions. From step 704 the design must extract desired boot characteristics such as the acceptable size constraints on the upper cuff and lower boot in step 714. For street hockey usage, the desired outer boot surface area would be much larger than for a racing application for example. With inputs from steps 716 and 714, step 718 is completed by specifying the specific height constraints of the cuff and lower boot. In step 720, a specific multi-hinge linkage is chosen from the potential solutions generated in step 716. Step 724 also follows step 714, wherein detailed calculations are performed such as structural analysis (which could include bending and torsion deflection analysis and or finite element analysis). Also, experimental methods can be applied and manufacturing constraints should be considered. For example, based on the projected cost ceiling and volume of sales, certain methods of manufacture may or may not be appropriate. This realization will in turn dictate design decisions which must be applied to boot step 726 along with input from step 720.

The boot system is prototyped and tested in step 728, leading to an evaluation in step 730. The designer will either accept and release the finished design to the market or reject it. If sufficient satisfaction is not reached, then modification is required. The process can actually then return to any of the previous steps of FIG. 17. The decision of how far one retreats in the multi-hinge skate boot design procedure depends on the time available and the level of dissatisfaction. For instance, the kinematic performance of the finished prototype of step 728 may be quite satisfactory but the lateral stiffness may be too high for the projected skating application of step 700. In this instance the designer may only want to return as far as step 724. FIG. 17 is a general template for the multi-hinge skate boot design procedure; modification of the steps is anticipated in appropriate circumstances.

Figure 18:
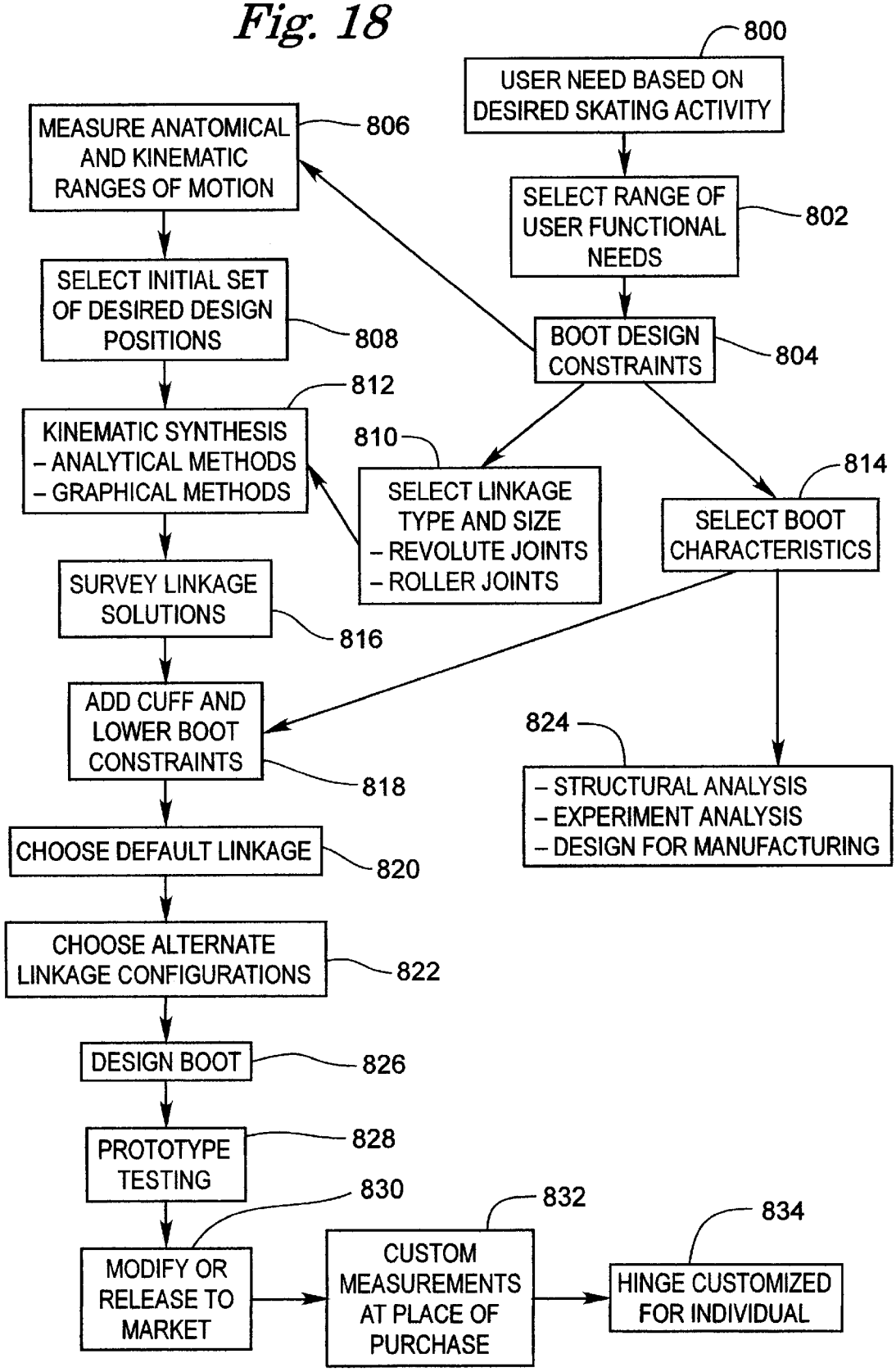
FIG. 18 is a flow diagram depicting a design procedure for custom design of a boot in accordance with the present invention.

FIG. 18 is a second flow diagram, outlining a custom skate boot design procedure. The first step 800 is to determine end user needs based on projected skating activity such as recreational in-line skating or street hockey. During the second step 802, the functional needs of skate users are sorted according to anticipated use and skill level. For example, the anticipated skill level may range from beginner to advanced recreational skaters; and general skating plus street hockey may be the projected uses. From this knowledge the designer determines boot design constraints for each sub grouping in the second step 804. These constraints may include desired ankle movements along the three orthogonal axes and stiffness of the boot hinge system. The next step 806 is to measure actual anatomical motion of a human in each of these sub groupings. This will help determine the resulting range of motion of that human in each specific skating activity that the boot is being designed for.

From this information, step 808 requires selection of an initial set of prescribed design positions (e.g. design positions 70, 72, 74 along with design angles 76 to create planar data 88 similar to TABLE 1). The selection of link joint types (pin, roller or slider) in step 810 is based on previous deliberations such as the desired skating activity in step 800 and the boot constraints of 804. In some cases, a multihinged mechanism with pin joints may make sense where in other cases rollers or sliders may be more appropriate. Next, kinematic synthesis (step 812) is carried out by either analytical methods (such a using the LINCAGES software as described above), or graphical methods. Based on the kinematic synthesis method chosen, step 816 includes surveying a number of potential solutions for the initial set of design positions. From step 804 the designer must extract desired boot characteristics for all uses anticipated in step 800 (such as the acceptable size constraints on the upper cuff and lower boot) in step 814. With inputs from steps 816 and 814, step 818 is completed when the specific height constraints of the cuff and lower boot are specified.

In step 820, a specific (default) multi-hinge linkage is chosen from the potential solutions generated in step 816. Alternative linkage configurations are selected in step 822 that satisfy the other needs identified in step 800. This step has the objective of identifying adjustments in the multi-hinge system that help customize the hinge to a specific end user. These adjustments should be simple to make, such as moving, a single or a small number of pivot location(s) on either the upper cuff or lower portion to a new location. Other adjustments might include changing the angle of a slot or the location of that slot. Also possible is a change of length of one of the rigid links of the hinge. This determination can be done by standard kinematic analysis of the default multi-hinge system with a systematic change of one parameter at a time or other optimization methods known in the art. The result of step 822 will be a default and a number of alternative multi-hinge configurations in which the adjustment from the default design to any of the others is simple and prescribed.

Step 824 also follows step 814, where detailed calculations are performed such as structural analysis (which could include bending and torsion deflection analysis and or finite element analysis). Also, experimental methods can be applied and manufacturing constraints should be considered. For example, based on the projected cost ceiling and volume of sales, certain methods of manufacture may or may not be appropriate. This realization will in turn dictate decisions which must be applied to the design of the boot in step 826. Also input from step 822 will help in the design of the adjustment system necessary for customization of this boot system. The boot is prototyped and tested in step 828 leading to an evaluation in step 830. The designer will either accept and release the finished design to the market or reject it. If sufficient satisfaction is not reached, then modification is required. The process can actually then return to any of the previous steps in FIG. 18. The decision of how far one retreats in the multi-hinge skate boot design procedure depends on the time available and the level of dissatisfaction. For instance, the kinematic performance of the finished prototype of step 828 may be quite satisfactory but the lateral stiffness may be too high for the projected skating application of step 800. In this instance, the designer may only want to return as far as step 824.

An end user would be asked questions about their skill level and the desired use of the skate boot at the place of purchase (step 832). The skater may even be tested (either range of motion or ankle strength or both). Based on these determinations, the multi-hinge is custom adjusted for that end user in step 834 (with input from the analysis done previously in step 826). It is also possible that the end user could be provided information of how to adjust the multi-hinge system for a change of skating activity, or for an alternate user such as in a rental situation. FIG. 18 is a general template for a custom skate boot design procedure which includes adjustable hinges; modification of the steps is anticipated in appropriate circumstances.

The present invention can include additions to the above embodiments, such as built-in limit stops in the lower boot to limit the range of motion of the multi-hinge system at either or both ends of the flexion—extension motion. Inner boots are well known in the art and are assumed possible additions. The addition of springs or spring elements between the lower boot and one or more members of the multi-hinge system is anticipated if assist is required (for example in the instance of spring return to a neutral position for the flex hinge embodiment in FIG. 16).

TABLE 1

| CUFF ANGLE | X LOCATION | Y LOCATION | |
|---|---|---|---|
| 137 DEGREES | 8.3 INCHES | 9.6 INCHES | 70 |
| 99 DEGREES | 4.0 INCHES | 12.3 INCHES | 72 |
| 75 D GREES | 0.7 INCHES | 12.7 INCHES | 74 |

What is claimed is:

1. A boot for an in-line skate, the skate having at least one ground surface engaging member disposed in a linear disposition, the boot having a first side and an opposed second side, comprising:

a lower portion;

an upper portion;

a linkage assembly operably coupling the lower portion and the upper portion about a boot pivot axis, the boot pivot axis being shiftable relative to the lower portion along a predetermined boot pivot axis path of travel, the boot pivot axis being defined by a first multi-element hinge having a first four link chain in cooperation with a second multi-element hinge having a second four link chain, wherein the first and second four link chains are each formed by first and second link members pivotally connected between the upper and lower portions; and an extension operably coupled to at least one of the lower and upper portions, said extension comprising a brake element.

2. A boot for an in-link skate, the skate having at least one ground surface engaging member disposed in a linear disposition, the boot having a first side and an opposed second side, comprising:

a lower portion;

an upper portion;

a linkage assembly operably coupling the lower portion and the upper portion about a boot pivot axis, the boot pivot axis being shiftable relative to the lower portion along a predetermined boot pivot axis path of travel, the boot pivot axis being defined by a first multi-element hinge having a first four link chain in cooperation with a second multi-element hinge having a second four link chain, wherein the first and second four link chains are each formed by first and second link members pivotally connected between the upper and lower portions; and a braking surface operably coupled to at least one of said upper and lower portions and shiftable between a non-braking position and a braking position by shifting the relative orientation of said upper and said lower portions.

3. The invention of claim 2, said lower portion being supported by at least one ground engaging wheel, said braking surface operably, frictionally engaging said ground engaging wheel when said braking surface is in said braking position.

* * * * *